US009126664B1

(12) United States Patent
Denson et al.

(10) Patent No.: US 9,126,664 B1
(45) Date of Patent: Sep. 8, 2015

(54) HIDDEN OUTBOARD ENGINE ENCLOSURES

(71) Applicants: John Clifford Denson, Merritt Island, FL (US); Thomas Bucaccio, Melbourne, FL (US); Frederick Charles Herrington, Cocoa Beach, FL (US)

(72) Inventors: John Clifford Denson, Merritt Island, FL (US); Thomas Bucaccio, Melbourne, FL (US); Frederick Charles Herrington, Cocoa Beach, FL (US); Martin Staric, Bled (SI)

(73) Assignee: Brunswick Corporation, Forest Lake, IL (US)

( * ) Notice: Subject to any disclaimer, the term of this patent is extended or adjusted under 35 U.S.C. 154(b) by 66 days.

(21) Appl. No.: 13/836,929

(22) Filed: Mar. 15, 2013

(51) Int. Cl.
*B63H 5/00* (2006.01)
*B63H 20/04* (2006.01)

(52) U.S. Cl.
CPC . *B63H 5/00* (2013.01); *B63H 20/04* (2013.01)

(58) Field of Classification Search
CPC ..... B63B 19/14; B63B 19/26; B63B 19/16; B63B 1/04; B63B 35/731; F02B 61/045; B63H 20/32; B63H 20/34
USPC ..... 114/201 R, 355, 357; 440/76
See application file for complete search history.

(56) References Cited

U.S. PATENT DOCUMENTS

| | | | | |
|---|---|---|---|---|
| 3,144,858 | A | 8/1964 | Horning et al. | |
| 3,371,362 | A * | 3/1968 | Butler | 114/355 |
| 3,452,704 | A | 7/1969 | Watkins | |
| 3,702,485 | A * | 11/1972 | Thompson | 114/355 |
| 3,790,977 | A * | 2/1974 | Bombardier et al. | 114/357 |
| 4,996,937 | A | 3/1991 | Niina et al. | |
| 4,997,398 | A | 3/1991 | Glen | |
| 5,129,847 | A | 7/1992 | Mondek | |
| 5,176,551 | A | 1/1993 | Blanchard et al. | |
| 5,409,409 | A | 4/1995 | Blanchard et al. | |
| 5,505,644 | A | 4/1996 | Ousley, II et al. | |
| 5,562,511 | A | 10/1996 | Blanchard et al. | |
| 7,056,172 | B2 | 6/2006 | Bernier | |
| 7,413,492 | B2 | 8/2008 | Meyer et al. | |
| 2009/0224132 | A1 | 9/2009 | Mochizuki | |
| 2012/0028517 | A1 | 2/2012 | Mochizuki et al. | |
| 2012/0115376 | A1 | 5/2012 | Daikoku et al. | |

FOREIGN PATENT DOCUMENTS

| | | |
|---|---|---|
| WO | 2010116576 | 10/2010 |

* cited by examiner

*Primary Examiner* — Lars A Olson
(74) *Attorney, Agent, or Firm* — Malin Haley DiMaggio & Bowen, P.A.

(57) ABSTRACT

A watercraft comprising a bow, a stern, a hull, a transom, and a deck. The transom is located at the stern of the watercraft and the deck extends forward from the transom. One or more cavities are disposed through the deck adjacent to the transom wherein the cavities are each configured to receive an outboard motor. An enclosure is disposed over each of the cavities, providing a means to hide and enclose the outdoor motor. Multiple enclosures can be provided where the watercraft is powered by multiple outboard motors. The top of the enclosure includes a seating surface, providing a sun deck for boaters. The enclosures are hingeably mounted to the deck to provide selective access to the enclosure's respective cavity and motor therein. The interior of the enclosures defines a curved surface to promote air turnover inside the enclosures, optimizing engine performance.

7 Claims, 7 Drawing Sheets

HIDDEN OUTBOARD ENGINE ENCLOSURES

CROSS REFERENCE TO RELATED APPLICATIONS

N/A

STATEMENT REGARDING FEDERALLY SPONSORED RESEARCH OR DEVELOPMENT

N/A

BACKGROUND OF THE INVENTION

1. Field of the Invention

The present invention generally relates to marine watercrafts and more specifically to outboard engine enclosures for marine watercrafts.

2. Description of Related Art

Marine watercrafts incorporate various means of propulsion including but not limited to internal combustion engines. Such engines are typically powered by a fossil fuel such as a gasoline and are configured to drive a driveshaft to which a propeller is connected. The engine therefore turns the propeller and the propeller converts the rotational power into thrust. More specifically, a pressure differential is produced between the forward and rear surfaces of the airfoil-shaped propeller, and the water is accelerated behind the blade. Marine watercrafts can utilize one or more engines depending on the size and configuration of the watercraft and desired power characteristics. For example, a small leisure craft may only require a small single engine while a large cruise liner may require several larger engines in order to provide optimal thrust and power output.

Marine watercrafts can be configured to operate with several styles of engines including, but not limited to, outboard motors, inboard motors, and inboard/outboard motors also known as stern drive motors. Outboard marine motors comprise a self-contained unit that includes engine, gearbox, and propeller or jet drive, designed to be affixed to the outside of the transom or rear platform of the watercraft. An inboard motor is an motor system wherein the engine and gearbox are mounted inside the hull of the watercraft whereby a driveshaft connects the external propeller to the gearbox. An inboard/outboard motor or "sterndrive" motor combines inboard power with outboard drive wherein the engine itself sits just forward of the transom while the drive unit lies outside the hull.

In the case of outboard marine motors, the motor also provides a means for steering the watercraft as the outboard motor is designed to pivot over its mountings and thus control the direction of thrust. Often times multiple outboard motors are provided on a watercraft to increase power output. These multiple outboard motors are typically linked at their mountings such that the motors pivot simultaneously in order to steer the watercraft. In addition to pivoting, outboard motors are also configured to tilt upward and downward to control the depth to which the propeller reaches. This allows the watercraft operator to traverse waters of varying depth in that the motor can be tilted upward to provide clearance in shallow waters. In the case of mid-size to large outboard powered watercrafts, the motor is typically bolted to the transom of the watercraft and is linked to controls at the helm. Such controls are often electronic and include one or more throttles, steering controls, and tilt controls.

Compared to inboard motors or stern drive motors, outboard motors have several advantages including smaller footprint, increased available cabin and cockpit space, improved simplicity, easier maintenance, easier replacement/retrofitting, and enhanced modularity. It is for these reasons that outboard motors are preferred for pleasurecraft and sport fishing boats. That being said, outboard motors have the disadvantage that the motor must be externally mounted to the transom of the watercraft. This can rob the rear of the watercraft of usable space for recreational activities such as swimming, diving, and fishing. Furthermore, the appearance of outboard motors is considered unsightly to some because the large powerhead and midsection of the motor is obtrusively visible at the stern of the watercraft. While there have been advancements in the overall aesthetics of outboard motors, there is a desire to provide a means to conceal the motors while still providing the several aforementioned advantages that outboard motors provide.

There have been some attempts at improving the aesthetics of marine watercrafts with respect to engine configurations, but none have adequately solved the problems outlined above. For example, U.S. Patent Application No. 2012/0115376 to Daikoku et al. describes an engine case that houses the engine inside and provides a propulsion unit outside of the case. The case's main compartment covers the engine parts and includes an opening at the upper rear portion through which the propulsion parts extent. Mufflers are installed on the lower surface of the case. The case is designed to mount to the transom of a watercraft such as an inflatable boat. The design is limited, however, in that it does not allow for the use of conventional outboard motors and the case does not provide an optimal environment for the motor with respect to temperature and moisture.

U.S. Pat. No. 7,413,492 provides a watercraft with a modular inboard/outboard motor configuration wherein a housing in the hull of the watercraft is adapted to completely enclose an engine with a drive shaft and propeller extending rearward to the transom. Essentially this system provides for a removable inboard engine. While this system allows for easier repowering, it fails to provide the general benefits of outboard motors in that service access to the engine compartment is compromised.

It is, therefore, to the effective resolution of the aforementioned problems and shortcomings of the prior art that the present invention is directed. However, in view of the outboard-powered marine watercrafts in existence at the time of the present invention, it was not obvious to those persons of ordinary skill in the pertinent art as to how the identified needs could be fulfilled in an advantageous manner.

SUMMARY OF THE INVENTION

The present invention provides several embodiments of a watercraft, comprising a bow, a stern, a hull, a transom, and a deck. The transom is located at the stern of the watercraft and the deck extends forward from the transom. One or more cavities are disposed through the deck adjacent to the transom wherein the cavities are each configured to receive an outboard motor. An enclosure is disposed over each of the cavities, providing a means to hide and enclose the outdoor motor. Multiple enclosures can be provided where the watercraft is powered by multiple outboard motors.

In some embodiments, the top of the enclosure includes a seating surface, providing a sun deck for boaters. In some embodiments, the enclosures are hingeably mounted to the deck to provide selective access to the enclosure's respective cavity and motor therein. In some embodiments, the interior of the enclosures defines a curved surface to promote air turnover inside the enclosures, optimizing engine performance. To assist in air turnover and dispel moisture and reduce internal enclosure temperature, the interior of the enclosure comprises a glossy surface. In some embodiments, the enclosures are three sided wherein the gunwale of the watercraft delimits the fourth side or lateral boundary of the enclosure.

In some embodiments the intake manifold of the motor is connected to a bilge area of the watercraft by a conduit. In some cases the bilge area is accessed by an aperture bored through the gunwale of the watercraft adjacent to the cavity within which the motor is disposed. The conduit is attached between the air intake of the motor and the aperature, thus drawing intake air from the bilge area to the motor. This prevents the motor from drawing intake air from the enclosure environment which may be too moist for optimal operation of the motor.

In a dual-motor set up, two cavities are provided each enclosed by an enclosure. In some embodiments, the cavities are separated by a passage extending from the transom to the cockpit area of the watercraft.

Accordingly, it is an object of the present invention to provide a modified watercraft comprising hidden outboard motors for improve aesthetics of existing outboard motor configurations.

It is another object of the present invention to enclose outboard motors to improve the amount of available deck space at the stern of a watercraft.

It is another object to the present invention to enclose outboard motors to improve safety and functionality of the watercraft at the stern thereof.

It is another object of the present invention to hide and enclose outboard motors while providing optimal air moisture and temperature conditions inside the enclosure.

In accordance with these and other objects which will become apparent hereinafter, the instant invention will now be described with particular reference to the accompanying drawings.

DETAILED DESCRIPTION

Figure 1:
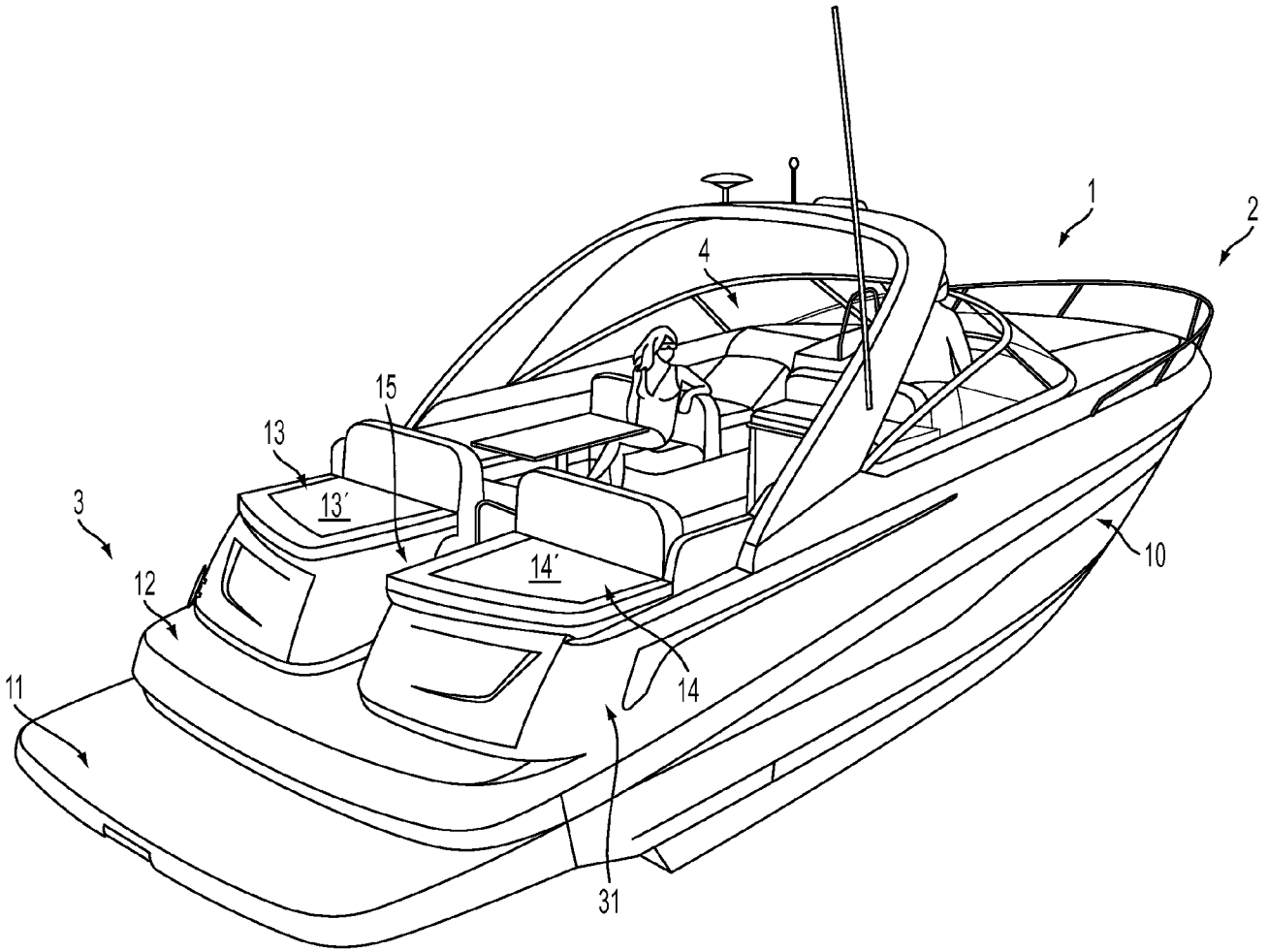
FIG. 1 is a rear perspective view of a watercraft incorporating one or more aspects of the present invention.
Figure 2:
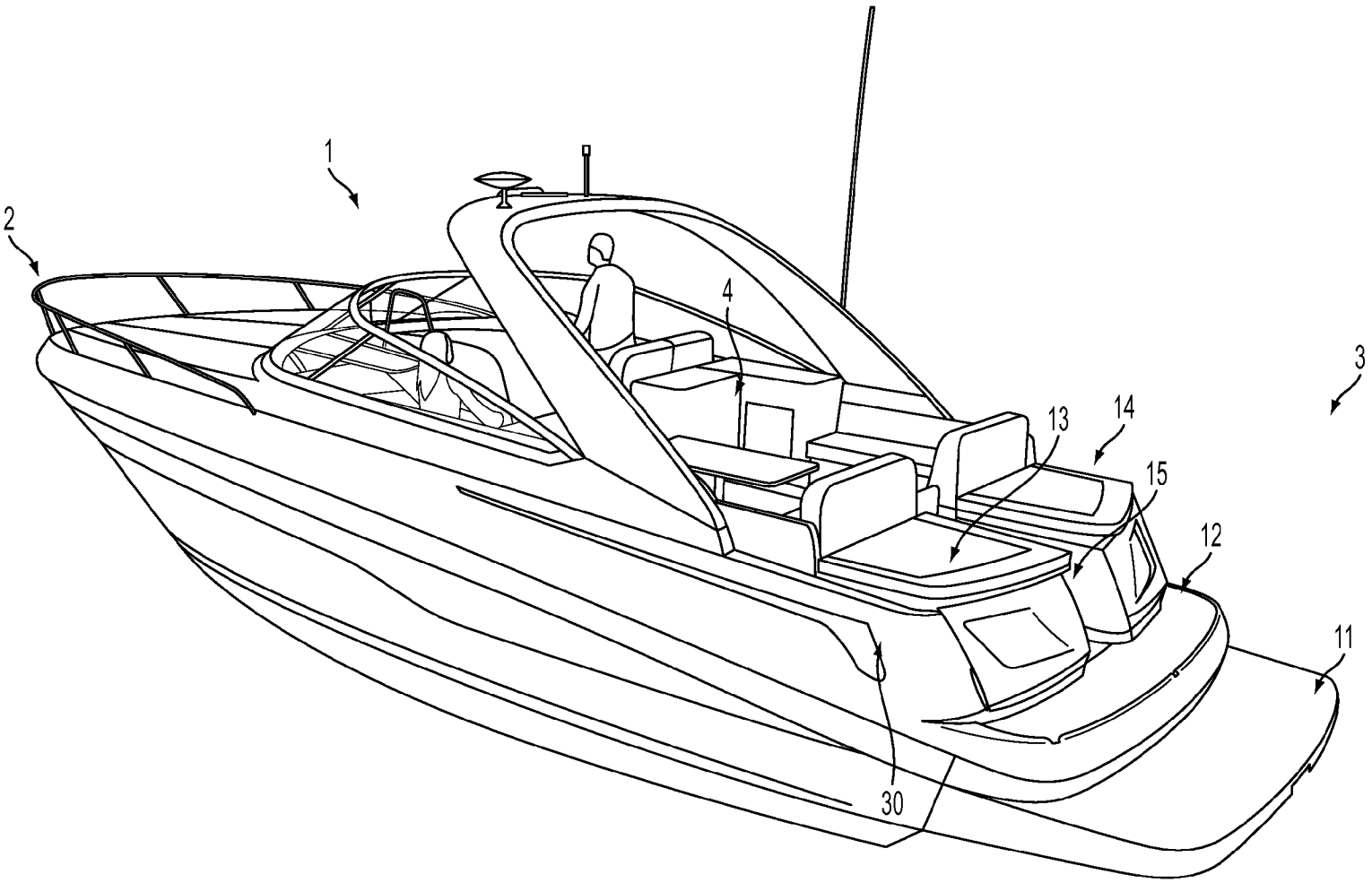
FIG. 2 is a side perspective view depicting a watercraft incorporating one or more aspects of the present invention.
Figure 3:
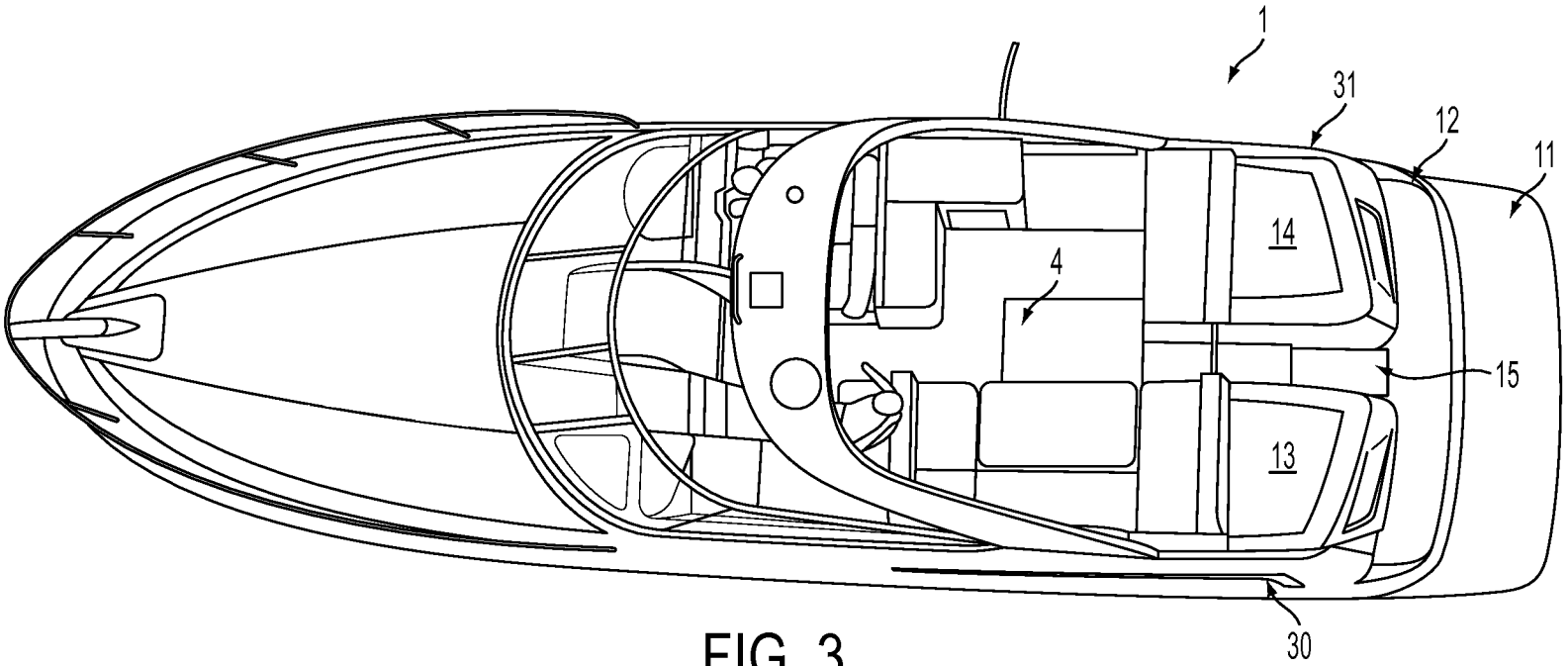
FIG. 3 is a top perspective view depicting a watercraft incorporating one or more aspects of the present invention.

With references to FIGS. 1-3 shown is watercraft 1 is configured as a boat having a bow 2 and a stern 3. Watercraft 1 includes a hull 10 and a transom 11, wherein the transom 11 defines a platform extending from the stern 3 of the watercraft. Extending forward of the transom 11 is a deck 12 also defining a platform surface. In some embodiments, the deck 12 is slightly elevated above the surface of the transom 11 but need not necessarily be. Deck 12 generally defines the deck of the watercraft 1 extending forward toward the cockpit 4 of the watercraft 1. Disposed at the rear of deck 12 adjacent to the transom 11 are a port engine enclosure 13 and a starboard engine enclosure 14. The top of the enclosures 13 and 14 define seating surfaces 13' and 14', respectively. The enclosures 13 and 14 are separated by passage 15 which provides access between the cockpit 4 and transom 11.

Figure 4:
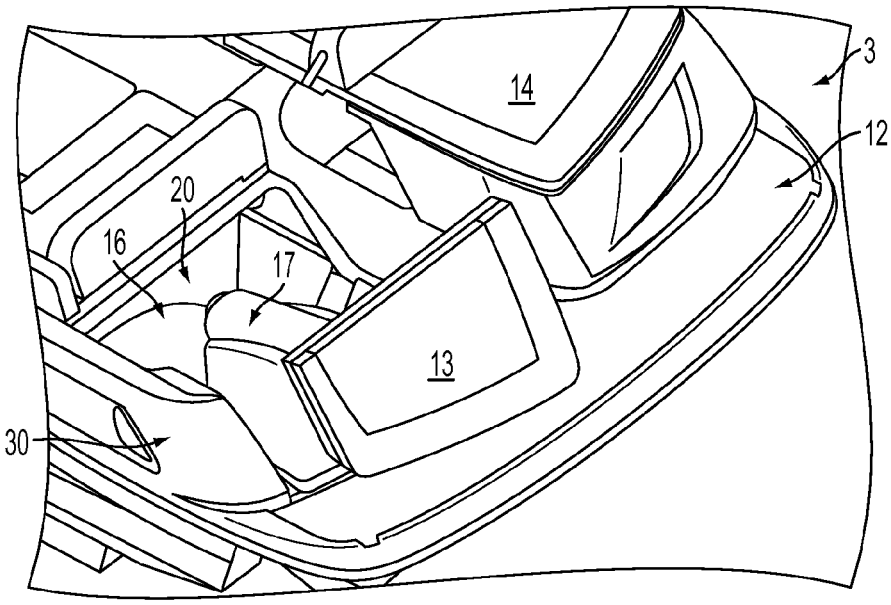
FIG. 4 is a port-side perspective view of the rear of a watercraft incorporating one or more aspects of the present invention.
Figure 5:
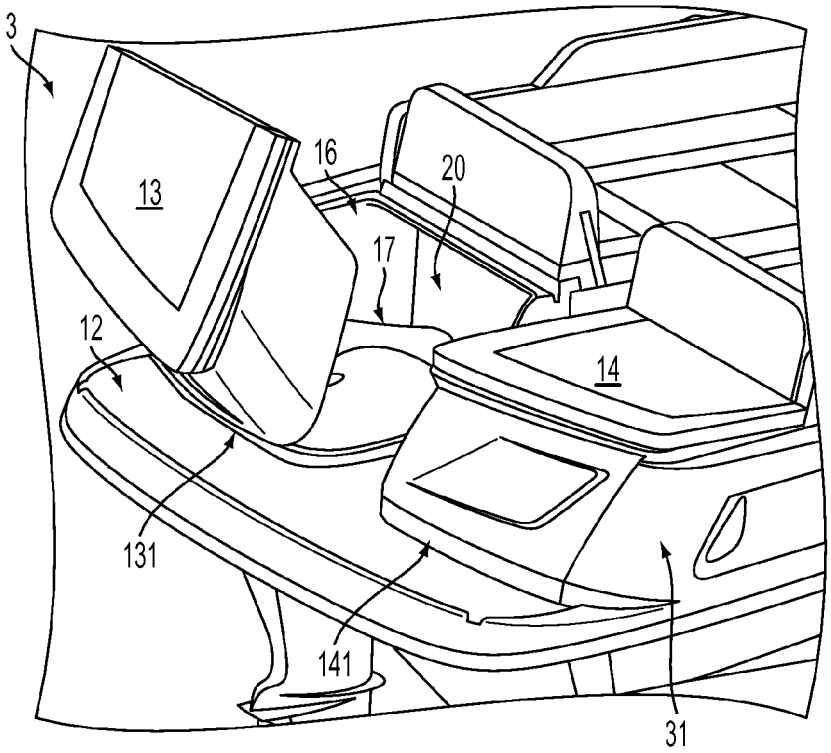
FIG. 5 is a starboard-side perspective view of the rear of a watercraft incorporating one or more aspects of the present invention.
Figure 6:
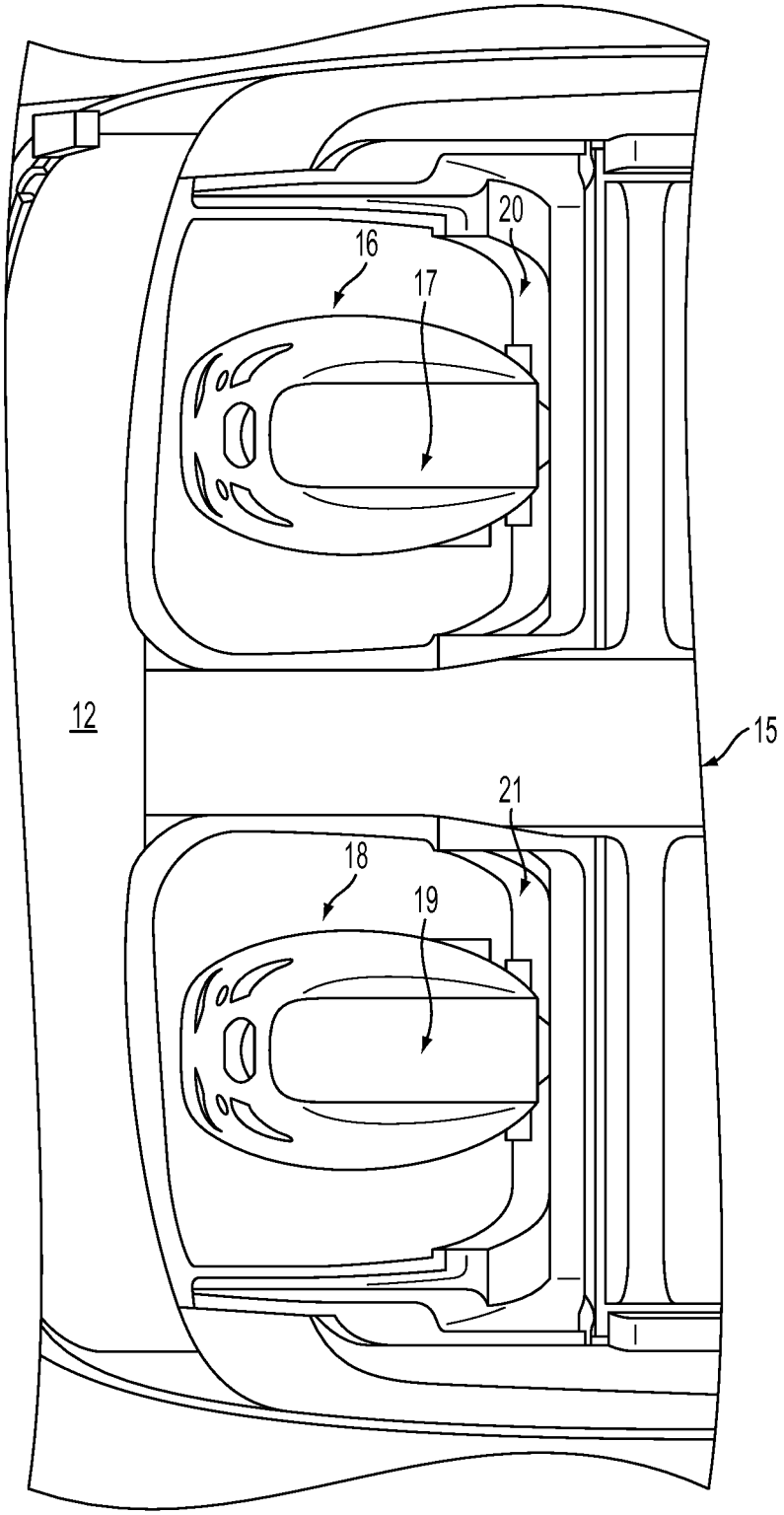
FIG. 6 is a top view of the rear of a watercraft incorporating one or more aspects of the present invention.

With reference to FIGS. 4-6, shown is the stern 3 of watercraft 1 in close up. As shown, located beneath the enclosures 13 and 14 are cavities 16 and 18 respectively. Cavities 16 and 18 are disposed through the deck 12 adjacent to the transom 11 and define a space to accommodate outboard motors 17 and 19, respectively. In some embodiments, cavities 16 and 18 are bored completely through deck 12 such that motors 17 and 19 are at least partially submerged in the water beneath the watercraft 1. In some embodiments, the front walls 20 and 21 of the cavities 16 and 18 provide a surface on which to mount the motors 17 and 19, respectively. Accordingly, enclosures 13 and 14 provide a means to hide and enclose the motors 17 and 19. In some embodiments, the enclosures 13 and 14 are hingeably attached to the deck 12 by hinges 131 and 141, respectively. In some embodiments, the enclosures 13 and 14 therefore hinge backward toward to the stern 3 of the watercraft 1 in order to expose the cavities 16 and 18 provide easy access to the motors 17 and 19.

With reference to FIG. 6, a top view of the configuration of the present invention is shown, with motor 17 mounted inside cavity 16 of deck 12. The enclosures 13 and 14 are omitted to better depict the cavities 16 and 18 and the motors 17 and 19. Further shown is the passage 15 disposed between the two motors/enclosures as well as the front wall 20 on which the motor 17 is mounted.

Figure 7:
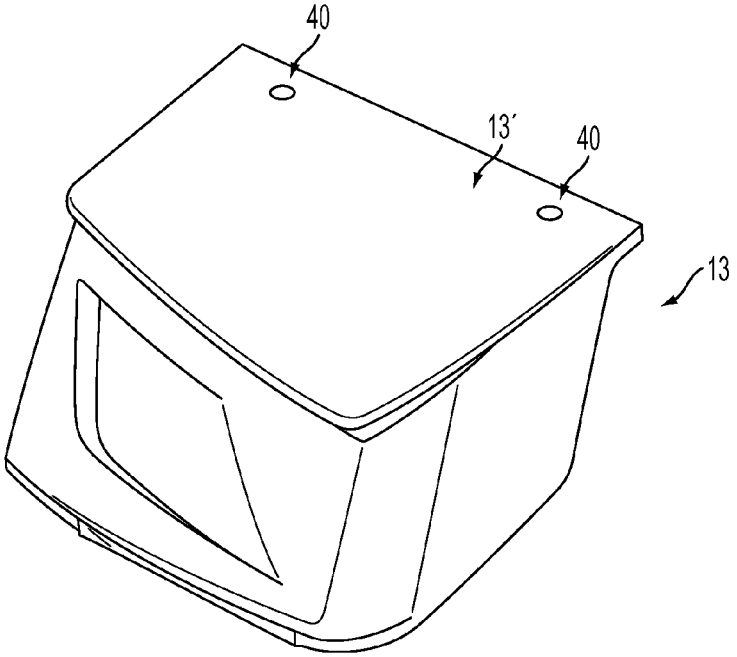
FIG. 7 is a perspective view of the outside of one embodiment of the enclosure aspect of the present invention.
Figure 8:
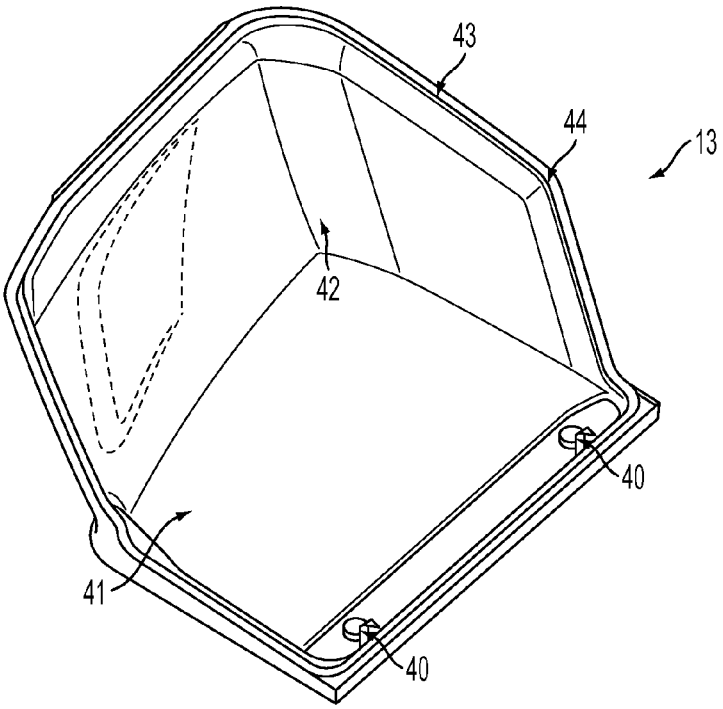
FIG. 8 is a perspective view of the interior of one embodiment of the enclosure aspect of the present invention.

FIGS. 7 and 8 depict an embodiment of the enclosure of the present invention, in this case port enclosure 13, in isolation. As seen, enclosure 13 is generally a three sided member having a seating surface 13'. With reference back to FIGS. 1-6, it is appreciated that the enclosure 13 meets the port gunwale 30 of the watercraft 1 in order to fully enclose the cavity 16 at the stern of the watercraft 1. Similarly, enclosure 14 meets the starboard gunwale 31 of watercraft 1 in order to fully enclose cavity 18 at the stern of the watercraft 1. Accordingly, the gunwales 30 and 31 delimit the outer boundary of their respective enclosure 13 and 14. It is appreciated that while the gunwales 30 and 31 of the watercraft 1 define the lateral boundaries of the enclosures 13 and 14, respectively, other configurations are possible. For example, the enclosure may be four sided and therefore discrete from the gunwales of the watercraft 1.

In some embodiments, the surface 13' includes one or more latches 40 which are configured to removably engaged the front wall 20 in order to secure the enclosure 13 to the watercraft 1 during operation. Further, in some embodiments, the perimeter 43 of the enclosure 13 includes a gasket 44 that, when the enclosure 13 is closed, provides a tight seal to reduce noise from the motor while also limiting air leakage from the motor's operation zone to the outside environment. In some embodiments, the gasket 44 comprises a rubber or rubber compound having a D-shaped cross-section. Other configurations of gaskets may be equally suitable.

The interior of the enclosures 13 and 14 are configured for optimal motor operating conditions including providing enough interior space to allow for full articulation of the motors 17 and 19 according to manufacturers' specifications. Further, in some embodiments, the interior surfaces of the enclosures 13 and 14 comprise a glossy surface with provides for easier cleaning as well as to allow water to slake away more readily to prevent moisture accumulation inside the enclosure 13 and 14, which could harm engine performance. Further, the enclosures 13 and 14 include curvature 42 (See FIG. 8) which promotes air turnover, thus ensuring cooler engine operating temperatures. The curvature 42 also promotes the dissipation of combustion gases inside the enclosure.

Figure 9:
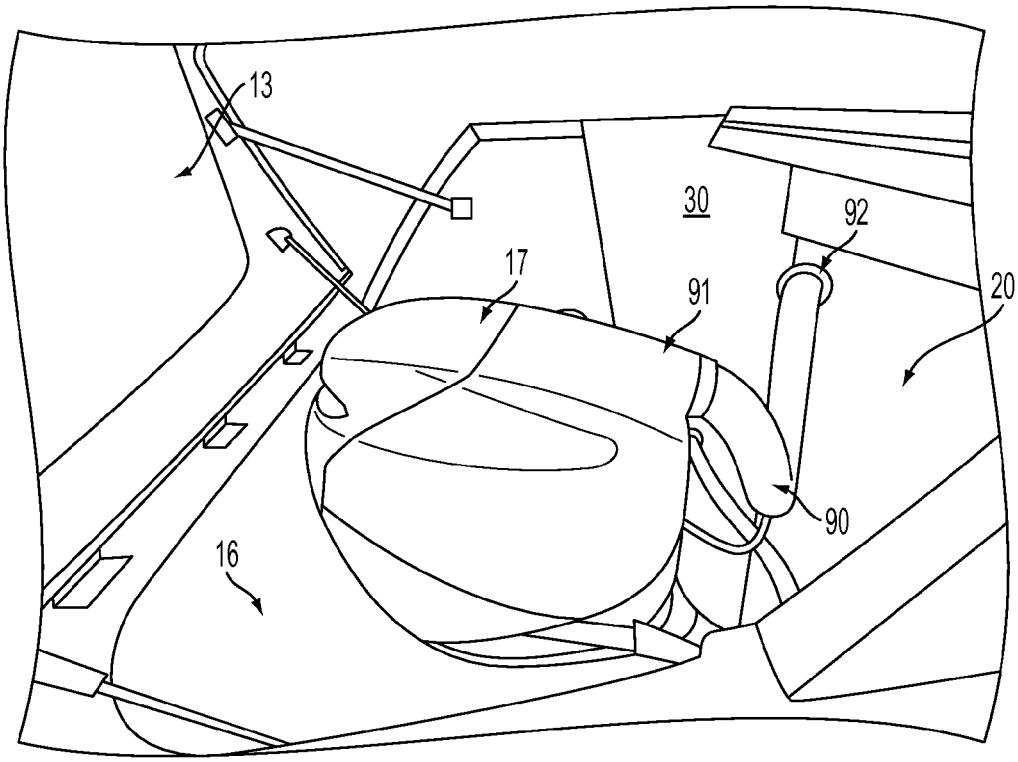
FIG. 9 is a side perspective view of a motor mounted to a watercraft in accordance with one or more aspects of the present invention.

With reference to FIG. 9, the present invention further enhances motor performance, convenience, and safety by not pulling intake air from the interior of the enclosures 13 and 14. Rather, in some embodiments, the present invention provides a connection between the engine air intake manifold and the bilge area of the watercraft 1, i.e. the space inside hull 10 of watercraft 1. Plumbing is provided in the form of a conduit 90 that is connected between the intake 91 of the motor 17 and an aperture 92 disposed on the interior of the gunwale 30 of the watercraft 1. The interior of the gunwale 30 is coextensive with the interior bilge area of the hull 10. This configuration allows air to be drawn from the bilge area to the intake manifold 91 of the motor 17 which ultimately mitigates the temperature and moisture content of the intake air. A similar configuration is provided with respect to motor 14 on the starboard side of the watercraft 1. The plumbing of air from the bilge area to the motor improves the overall quality of the intake air, improving performance as compared to allowing the motor to take air from the moister, warmer motor enclosure 13 and 14 area.

It is appreciated that the enclosures 13 and 14 may comprise a variety of materials including fiberglass, plastics, resins, and combinations thereof. It is further appreciated that the size and overall shape of the enclosures 13 and 14 can vary depending on the size of the motor or motors selected to power a given watercraft 1. It is understood, however, that the interior curvature 42 should be maintained for improved air turnover and expulsion of combustion gases.

With the configuration of the present invention, usable deck space at the stern of the vessel is greatly increased because the outboard motors are hidden and concealed by the enclosures 13 and 14 which provide seating surfaces 13' and 14'. Further, deck space and usability is enhanced because there is unobstructed deck and transom surface area extending rearwardly past the motors. This is also a safer configuration for boaters who wish to access the stern of the vessel as the motors are not exposed to the boater. Further still, the boat operator maintains the benefits of outboard motors while enjoying a more streamlined and pleasing appearance of the watercraft.

The instant invention has been shown and described herein in what is considered to be the most practical and preferred embodiments. It is recognized, however, that departures may be made therefrom within the scope of the invention and that obvious modifications will occur to a person skilled in the art.

What is claimed is:

1. A watercraft, comprising:

a bow, a stern, a hull, a transom, and a deck;

said transom located at said stern of said watercraft and said deck extending forward from said transom;

two cavities disposed through said deck adjacent to said transom wherein said cavities are each configured to receive an outboard motor having a motor cover;

a secondary enclosure disposed over each of said two cavities, providing a means to hide and enclose said outboard motor and motor cover; and said two cavities each enclosed by one said enclosure wherein said cavities are separated by a passage extending from said transom to a cockpit area of said watercraft.

2. The watercraft of claim 1 wherein the top of said enclosure includes a seating surface.

3. The watercraft of claim 1, wherein said enclosure is hingeably mounted to said deck to provide selective access to its respective cavity.

4. The watercraft of claim 1, wherein the interior of said enclosure defines a curved surface to promote air turnover inside said enclosure.

5. The watercraft of claim 1 wherein a gunwale of said watercraft delimits the lateral boundary of said enclosure.

6. A watercraft, comprising:

a bow, a stern, a hull, a transom, and a deck;

said transom located at said stern of said watercraft and said deck extending forward from said transom;

one or more cavities disposed through said deck adjacent to said transom wherein said cavities are each configured to receive an outboard motor having a motor cover;

a secondary enclosure disposed over each of said one or more cavities, providing a means to hide and enclose said outboard motor and motor cover; and an intake manifold of said motor is connected to a bilge area of said watercraft by a conduit.

7. A watercraft, comprising:

a bow, a stern, a hull, a transom, and a deck;

said transom located at said stern of said watercraft and said deck extending forward from said transom;

one or more cavities disposed through said deck adjacent to said transom wherein said cavities are each configured to receive an outboard motor having a motor cover;

a secondary enclosure disposed over each of said one or more cavities, providing a means to hide and enclose said outboard motor and motor cover; and the interior of said enclosure comprises a glossy surface to prevent moisture accumulation inside said enclosure.

* * * * *